US005409234A

United States Patent [19]

Bechter

[11] Patent Number: 5,409,234

[45] Date of Patent: Apr. 25, 1995

[54] MULTI-LEVEL GAME APPARATUS, INTERFACING PIECES, AND METHOD OF PLAY

[76] Inventor: Frank Bechter, P.O. Box 55, Crozier, Va. 23039

[21] Appl. No.: 143,654

[22] Filed: Nov. 1, 1993

[51] Int. Cl.[6] ..... A63F 3/00

[52] U.S. Cl. ..... 273/241; 273/271; 273/290

[58] Field of Search ..... 273/271, 241, 290

[56] References Cited

U.S. PATENT DOCUMENTS

| | | | |
|---|---|---|---|
| 2,676,018 | 4/1954 | Cornish | 273/271 |
| 2,896,950 | 7/1959 | Rosti | 273/290 |
| 3,169,769 | 2/1965 | Cornish | 273/291 |
| 3,464,701 | 9/1969 | Mahoney | 273/241 |
| 3,684,285 | 8/1972 | Kane | 273/241 |
| 3,879,040 | 4/1975 | Smith | 273/241 |
| 3,884,474 | 5/1975 | Harper | 273/241 |
| 4,019,743 | 4/1977 | Castanis | 273/241 |
| 4,082,283 | 4/1978 | LaFerla | 273/241 |
| 4,239,230 | 12/1980 | Shoptaugh | 273/264 |
| 4,385,764 | 5/1983 | Bhatti | 273/243 |
| 4,643,432 | 2/1987 | Berry | 273/260 |
| 4,700,951 | 10/1987 | Lachenmeier et al. | 273/264 |
| 4,883,278 | 11/1989 | Scott | 273/241 |
| 5,085,440 | 2/1992 | Van Dam | 273/241 |
| 5,195,750 | 3/1993 | Courialis | 273/241 |
| 5,249,805 | 10/1993 | Neil et al. | 273/271 |

*Primary Examiner*—Benjamin H. Layno

[57] ABSTRACT

A four dimensional game and a three dimensional apparatus (10) used for playing the game are disclosed. The game consists of a playing field divided into playing zones (420) of equal receptivity to all playing tokens, there being at least two mutually distinguishable groups of playing tokens. In a preferred embodiment, the game is played on a three dimensional playing field. Players place three or more distinct kinds of playing tokens one-per-turn onto the initially empty playing field according to a continuous and sequential order, such that the kind of token added to the playing field is governed entirely by the given turn in a manner known and predictable to all players. Each token, as evident by its shape, occupies either an entire playing zone or a distinct portion of a playing zone, such that different kinds of playing tokens, whether belonging to the same player or to different players, may occupy the same playing zone provided that no two of these playing tokens occupy any same distinct portion of the given playing zone. The object of the game is to attain a winning alignment (500) of playing tokens, wherein a winning alignment comprises a straight and contiguous line of playing zones all containing tokens of one player which occupy the same distinct portion of each playing zone therein. The fourth or temporal dimension of the game is manifest through the continuous and sequential application onto the playing field of distinctly different, yet compositionally interrelated, playing tokens, whereby time is particularized into predictable and significantly distinct units, much as height, width, and depth are particularized into predictable and significantly distinct units on the three dimensional playing field. The three dimensional playing field apparatus comprises rigid and transparent playing boards (400) being held in a stacked configuration by a two-piece, interlocking, hinge-like support frame (100 & 200), the entire apparatus being both markedly easy to assemble and disassemble and markedly accessible for the placement of playing tokens thereon, representing a significant improvement over previous apparatuses designed for similar games.

18 Claims, 9 Drawing Sheets

Figure 7A
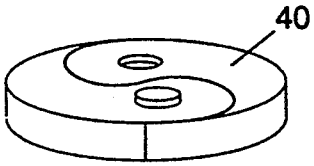
Figure 7B
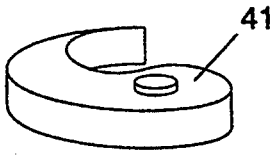
Figure 7C
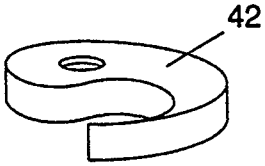
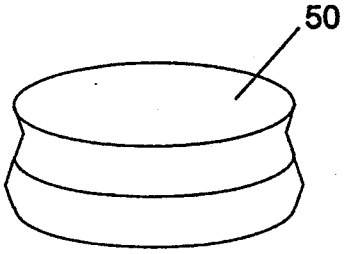
Figure 7D
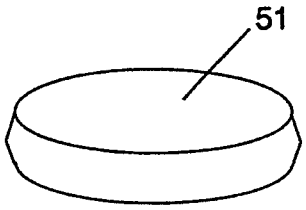
Figure 7E
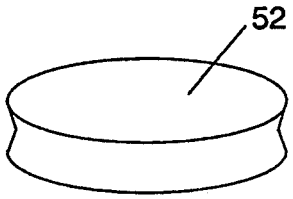
Figure 7F Figure 8A
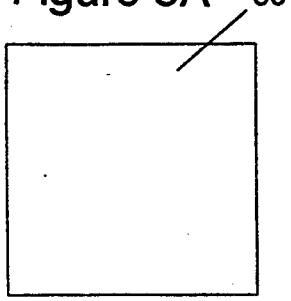
Figure 8B
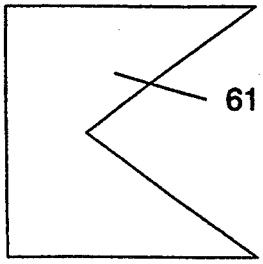
Figure 8C
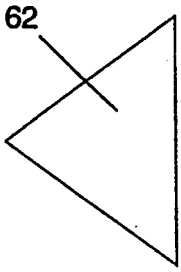
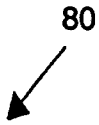
Figure 8D
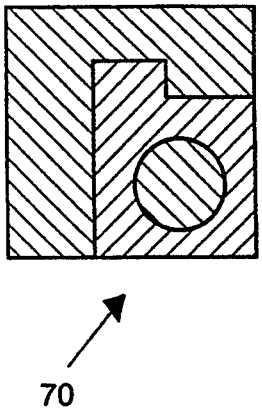
Figure 8E
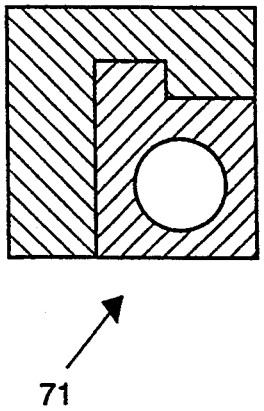
Figure 8F
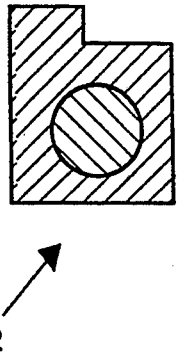
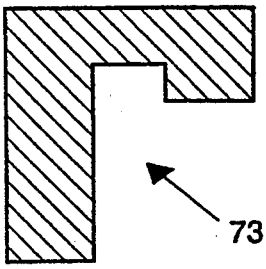
Figure 8G
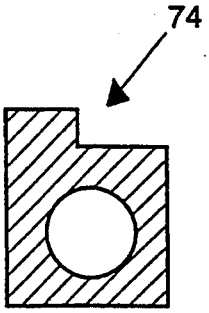
Figure 8H
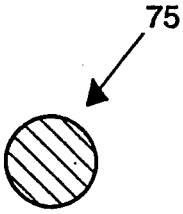
Figure 8I

MULTI-LEVEL GAME APPARATUS, INTERFACING PIECES, AND METHOD OF PLAY

BACKGROUND

1. Field of the Invention

This invention relates to games, and, more particularly, to the structural apparatus or edifice used for a playing matrix in three-dimensional strategy games, and, in addition, to a particular class of strategy game, for two or more people, aimed towards aligning playing tokens on a playing field of up to three spatial dimensions, divided into playing zones of identical receptivity to all playing tokens, onto which players, according to a continuous and sequential order of adding three or more distinct kinds of playing tokens one-per-turn to the initially empty playing field, place these distinct kinds of tokens, each token, as evident by its shape, occupying either an entire playing zone or a distinct portion of a playing zone, onto particular playing zones, such that the kind of token added to the playing field is governed entirely by the given turn in a manner known and predictable to all players, and such that different kinds of playing tokens, whether belonging to the same player or to different players, may occupy the same playing zone provided that no two of these playing tokens occupy any same distinct portion of the given playing zone, and such that the playing zones comprising winning alignments all contain pieces of one player which occupy the same distinct portion of each playing zone therein.

2. Description of Prior Art

Numerous alignment games, or games with tic-tac-toe themes, have been devised in recent years. Many of these games have comprised mere expansions of conventional Tic Tac Toe onto a three dimensional playing matrix. The three dimensional game edifices conceived range from stackable trays as in U.S. Pat. No. 3,879,040 to Smith (1975), to stacked levels using various support mechanisms as in U.S. Pat. No. 5,195,750 to Courialis (1993), U.S. Pat. No. 5,085,440 to Van Dam (1992), U.S. Pat. No. 4,019,743 to Castanis (1977), and U.S. Pat. No. 5,249,805 to Neil et al (1993); U.S. Pat. No. 2,676,018 to D. Cornish et al (1947) comprises an edifice employing removable trays (and also removable posts in an alternate embodiment) inserted vertically into a support base.

The playing field trays (or posts) of both the Smith and Cornish et al patents, which must be removed for the placement of playing tokens onto the playing matrix, do not, by definition, allow for actual play within the three dimensions of the edifice; as a result, play is both cumbersome and prone to mishap, as well as to strategic errors engendered by the constant upsetting of the field of view.

Edifices, such as the patent to Van Dam, having multiple playing fields supported by a single column or post, are prone to wobbling from side to side, and to misalignment of the various playing fields, and, in general, achieve only moderate structural stability through painstaking assembly processes often involving screws, clamps, glue, or markedly tight tolerances of linkage which are prone to breakage of parts.

Single-column support edifices like that of Van Dam, as well as multiple column support edifices such as the patent to Castanis, further involve structural and visual interruption of the various playing fields, leaving the edifices prone to mishap caused by the manual application of playing tokens, as well as causing optical confusion to the players; this optical confusion persists even when the support columns are transparent, as light refraction off of the support columns may appear to define playing zones.

In addition, multiple column support edifices, like the patent to Neil et al, must rely heavily upon sophisticated or markedly precise means of linking the playing fields to the support columns, or else remain laterally unsound. The edifice of Neil et al, in addition, is prone to marked downward tilting on the sides of the various playing fields opposite the attachments to the supporting columns. Furthermore, the manufacture of all of the above edifices involves multiple processes or materials which increases costs.

Moreover, the method of play conceived of for these three dimensional edifices, except for the patent to Castanis which involved a Scrabble-like word game, comprised nothing more than an "X" and "O" tic-tac-toe approach, with players employing either uniform marbles or playing tokens. Winning alignments were fairly easy to see being constructed, and the game involved little strategy or imagination, and, even if viable, represented little more than uninspiring or dead-end games.

Several two dimensional alignment games have also been devised to add new flavor to the tic-tac-toe theme. U.S. Pat. No. 4,700,951 to Lachenmeier et al (1987) comprises a tic-tac-toe game played with a plurality of identically-valued tokens each possessing a distinct marker indicating the order in which it must first be placed on the playing field and thereafter moved upon the playing field. Although tokens are manipulated in a particular order, there is nothing about that order which restricts the capability of any distinctly marked token from forming an alignment with any of the other distinctly marked tokens; alignments may be formed with any combination of a player's tokens. Points are given when alignments are formed, a game ending in the accumulation of a certain number of points.

U.S. Pat. No. 4,239,230 to Shoptaugh (1980) comprises an alignment game involving differently shaped playing tokens capable of sharing playing zones within the two dimensional playing field. The various playing tokens are added to the playing field without any prescribed order, each player choosing on each turn which token he or she would like to add next to the playing field. As with the Lachenmeier game, players are able to move pieces on the playing field. Various arbitrary rules are established restricting the application of certain tokens to certain zones, such that, for example, two tokens of two different distinct shapes can share a zone only if the two tokens belong to different players. Winning alignments or configurations comprise a set of predetermined arbitrary arrangements of playing tokens, some involving all of the distinct types of playing pieces.

The present invention involves a game having different rules and characteristics of play from all those described above, and, further, having a three-dimensional playing field edifice structurally superior to all those described above. Details of the playing field edifice and of the game and its method of play are described in detail herein below. The details of the method of play will reveal the game of the present invention, in comparison to those described above, to be acting within a fundamentally larger, more challenging, and more focused strategic paradigm—a four dimensional paradigm.

SUMMARY OF THE INVENTION

It is an object of the present invention to provide a four dimensional strategic board game, or a game acting or functioning within regular, predictable, and distinctly and significantly partitioned dimensions of width, depth, height, and time.

It is another object of the present invention to provide a game which has rules of minimal complexity, having no arbitrary restrictions or limitations imposed beyond the obvious spatial and temporal dimensions defining the playing tokens and the playing field; such that any person, young or old, familiar with the game of tic-tac-toe, will be able to quickly learn, understand, and begin playing the game.

It is another object of the present invention to provide a means for representing the fourth dimension of time with the more tangible attributes of space, thereby rendering this facet of the game transparent, self-evident, or unintimidating.

It is another object of the present invention, in accordance with the previous object stated, to provide a game which is easy and enjoyable to play, not requiring any sophisticated understanding or awareness of the four dimensional character of the game.

It is another object of the present invention to provide a game which is challenging and requires the development of competitive playing strategies towards one focused end.

It is another object of the present invention to provide a game and playing field apparatus having a minimal amount of components.

It is another object of the present invention to provide a three dimensional playing field apparatus which is sturdy and shock-resistant, both vertically and laterally stable, easily movable, and markedly able to remain intact despite significant tiltings of the apparatus.

It is another object of the present invention to provide a three dimensional playing field apparatus which is markedly facile, quick, and uncomplicated to assemble and disassemble; the apparatus of the invention requiring no highly precise fittings, and no clamps, screws, snaps, springs, glue or any other such added devices or mechanisms traditionally employed for securing similar three-dimensional apparatuses, including the use of exceptionally tight tolerances at linkages.

It is another object of the present invention to provide a three dimensional playing field apparatus which is substantially free of optical confusion to players, and markedly accessible for the manual placing of playing tokens on the various planar playing fields comprising the apparatus.

It is another object of the present invention to provide a three dimensional playing field apparatus which is easily and inexpensively packageable, and easily and inexpensively manufacturable.

It is another object of the present invention to provide a three dimensional playing field apparatus which is aesthetically pleasing.

These, together with other objects, features and advantages, which will become subsequently apparent, reside in the details of construction and operation as more fully herein described below, reference being had to the accompanying drawings forming a part hereof, wherein like numerals refer to like parts throughout.

BRIEF DESCRIPTION OF THE DRAWINGS

FIG. 7A is a perspective view of the integral token, or "yin-yang" token, in a second embodiment of the "whole", "half-A", and "half-B" paradigm.

FIG. 7B is a perspective view of one of the distinct fractional tokens, or the "yin" half-token, in the second embodiment.

FIG. 7C is a perspective view of the other distinct fractional token, or the "yang" half-token, in the second embodiment.

FIG. 7D is a perspective view of the integral token, or "stacked" token, in a third embodiment of the "whole", "half-A", and "half-B" paradigm.

FIG. 7E is a perspective view of one of the distinct fractional tokens, or the "convex-half" token, in the third embodiment.

FIG. 7F is a perspective view of the other distinct fractional token, or the "concave-half" token, in the third embodiment.

FIG. 8A is a top view of the integral token, or "square" token, in a fourth embodiment of the "whole", "half-A", and "half-B" paradigm.

FIG. 8B is a top view of one of the distinct fractional tokens, or the "pentagonal-half" token, in the fourth embodiment.

FIG. 8C is a top view of the other distinct fractional token, or the "triangle-half" token, in the fourth embodiment.

FIG. 8D is a top view of the integral token, or "whole-ABC" token, in an embodiment of a "whole", "two-thirds-AB", "two-thirds-BC", "third-A", "third-B", and "third-C" paradigm of integral and distinct fractional thirds-tokens, or paradigm 2.

FIG. 8E is a top view of one of the distinct fractional two-thirds tokens, or the "two-thirds-AB" token, of the embodiment of paradigm 2.

FIG. 8F is a top view of the other distinct fractional two-thirds token, or the "two-thirds-BC" token, of the embodiment of paradigm 2.

FIG. 8G is a top view of one of the distinct fractional one-third tokens, or the "third-A" token, of the embodiment of paradigm 2.

FIG. 8H is a top view of another of the distinct fractional one-third tokens, or the "third-B" token, of the embodiment of paradigm 2.

FIG. 8I is a top view of the last of the distinct fractional one-third tokens, or the "third-C" token, of the embodiment of paradigm 2.

REFERENCE NUMERALS IN DRAWINGS

Figure 1:
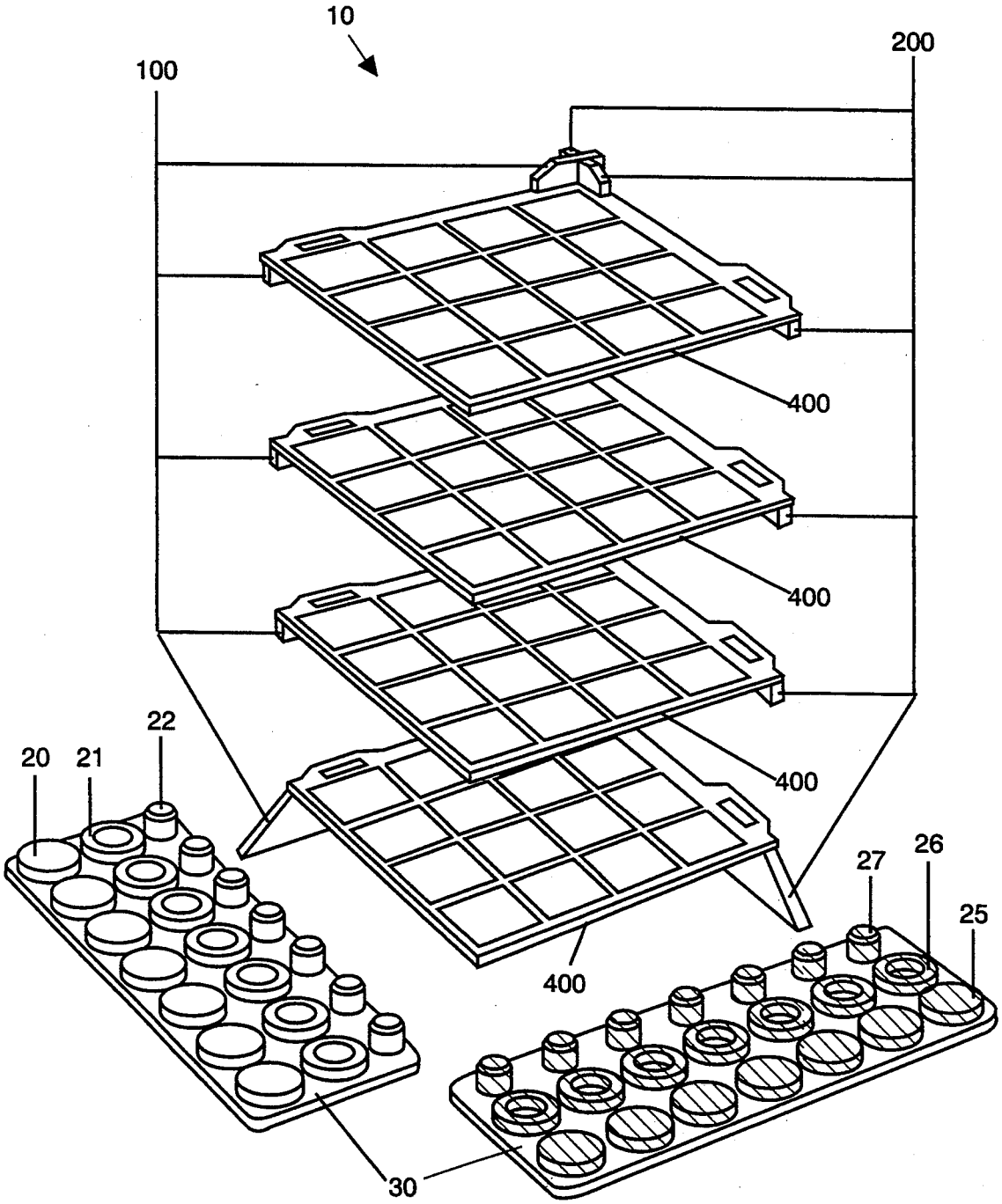
FIG. 1 is an overall perspective view of the game board apparatus of embodiment 1 and the accompanying playing tokens of embodiment 1 contained within the token holder of embodiment 1.

10—complete playing board apparatus (jaal)
20—white (player 1) disc (whole) or integral token
21—white (player 1) ring (half-A) fractional token
22—white (player 1) peg (half-B) fractional token
25—black (player 2) disc (whole) or integral tokens
26—black (player 2) ring (half-A) fractional token
27—black (player 2) peg (half-B) fractional token
30—playing token holder or token-ordering mechanism (crypt)
40—embodiment 2 integral token
41—embodiment 2 half-A fractional token
42—embodiment 2 half-B fractional token
50—embodiment 3 integral token
51—embodiment 3 half-A fractional token
52—embodiment 3 half-B fractional token
60—embodiment 4 integral token
61—embodiment 4 half-A fractional token
62—embodiment 4 half-B fractional token
70—embodiment 5 integral token
71—embodiment 5 two-thirds-AB fractional token
72—embodiment 5 two-thirds-BC fractional token
73—embodiment 5 third-A fractional token
74—embodiment 5 third-B fractional token
75—embodiment 5 third-C fractional token
80—embodiment of an integral-in-thirds paradigm
100—overhooking support leg
110—gap under top of 100
120—jut by counterweight of 100
130—gap by counterweight of 100
140—counterweight of 100
150—rear restraining hook of 100
160—support post of 100
170—foot or bottom base of 100
180—jut on top of 100
200—underhooking support leg
210—jut under top of 200
220—gap by counterweight of 200
230—jut by counterweight of 200
240—counterweight of 200
250—rear restraining hook of 200
260—support post of 200
270—foot or bottom base of 200
280—gap at top of 200
300—support arm
310—nib or vertical restrictor mate
320—tab or lateral restrictor mate
330—notch
340—tapered corner
400—playing board
410—playing field or non-linkage related area
420—playing zone
430—wing or supporting projection
440—nose or corner of intersection of adjacent sides
450—innermost edge of wing or corner linkage mate or fin
460—exposed side of inner corner of playing field
470—cavity or distal linkage mate
480—innermost playing zone
500—winning alignment of playing tokens of embodiment 1
600—non-winning alignment of playing tokens of embodiment 1
700—example of opposing players sharing occupation of a zone

DETAILED DESCRIPTION

In a preferred form of the present invention shown in FIG. 1, a three dimensional playing board apparatus 10 is constructed out of rigid and transparent material and comprises four playing boards 400, each playing board having a symmetrical playing field 410 comprising sixteen playing zones 420; the apparatus is, thus, a four by four by four playing matrix. The apparatus 10 further comprises a support structure.

Figure 2:
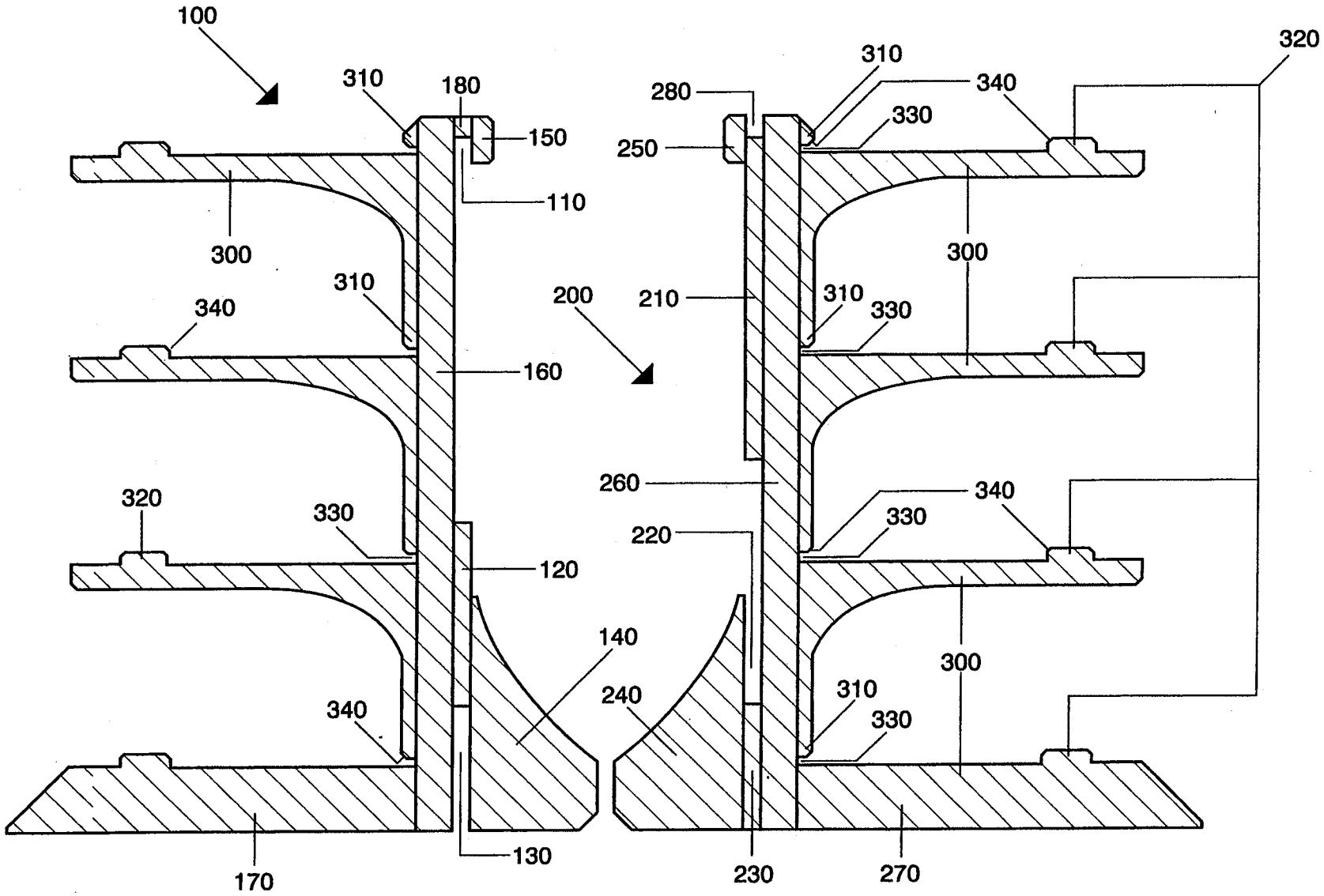
FIG. 2 is a side view of the two interlocking support legs of the game board apparatus of embodiment 1, showing significant coupling areas.
Figure 4:
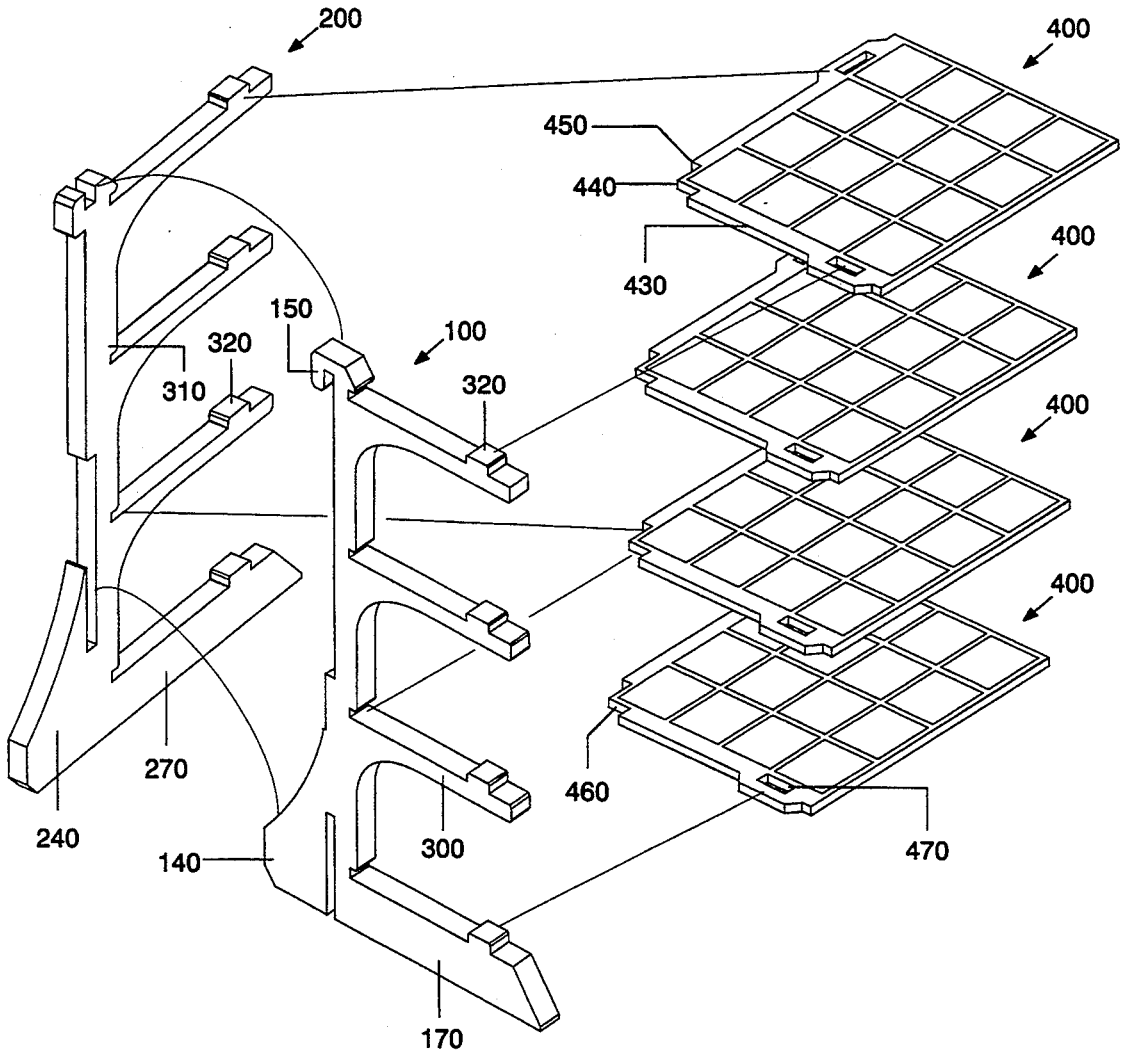
FIG. 4 is an exploded perspective view of the playing board apparatus of embodiment 1, showing assembly

FIG. 4 shows an exploded view of the game board apparatus 10 of this preferred form, herein named embodiment 1, showing assembly. Referring to the side view of support legs 100 and 200 shown in FIG. 2 for clearer depiction of the following parts here recited, the assembly of FIG. 4 is achieved wherein the overhooking support leg 100 interlocks with the underhooking support leg 200, whereby counterweight 140 slides through gap 220, enabling gap 130 to fit over jut 230, and jut 120 to fit into gap 220; and simultaneously whereby jut 180 slides into gap 280, and jut 210 fits into gap 110. In addition, rear restrainer hooks 150 and 250 and counterweights/rear restrainer hooks 140 and 240 thereby slip into position to hold the interlocked apparatus together at a substantially perpendicular intersection.

Figure 3:
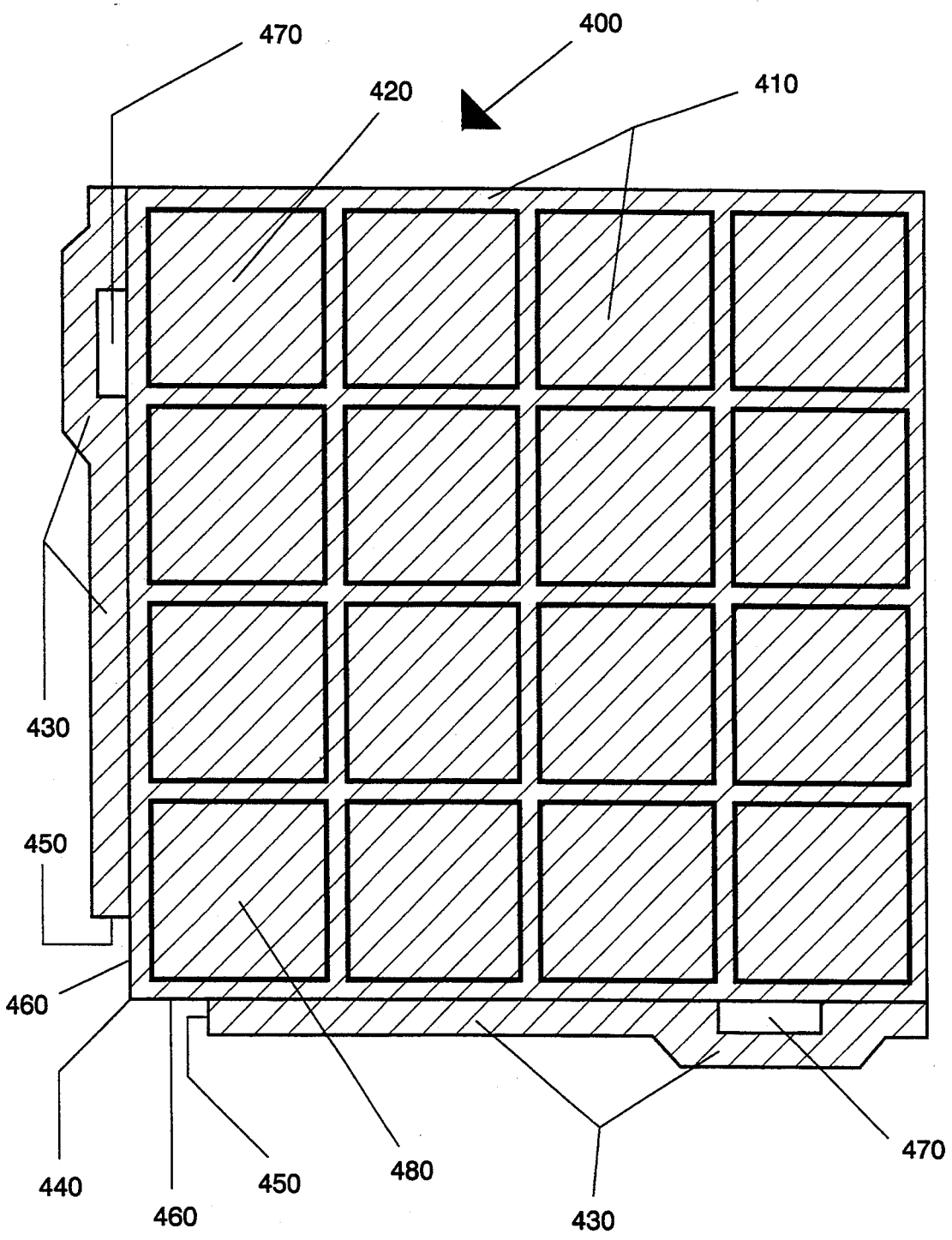
FIG. 3 is a top view of one of the four identical playing boards of embodiment 1, showing significant coupling areas.

This perpendicular intersection is designed to couple with the orthogonal sides of the playing boards 400 of FIG. 3. After support legs 100 and 200 are interlocked, playing boards 400 fit into the interlocked structure, wherein the nose 440 of the playing board butts directly into the intersection of support legs 100 and 200 which is, in effect, at the intersection of their support posts 160 and 260. The exposed sides 460 of the inner corner of the playing field 410 measure slightly greater than the widths of the support posts and thereby fit comfortably around them. The innermost edges 450 or corner linkage mates of the playing boards fit securely into the notches 340 of the support posts 160 and 260, directly under the nibs 310 or vertical restrictor mates. The cavities 470 or distal linkage mates, located near the ends of the support wings 430 opposite those of the innermost edges 450 where the wings begin, fit securely around the tabs 320 or lateral restrictor mates located atop the support arms 300 of the support legs 100 and 200. Tapered corners 340 facilitate the mating of these components. Significantly, the distance between the ends of the nibs 310 and the beginnings of the tabs 320 is slightly less than the distance between the innermost edges 450 and the beginnings of the cavities 470 on the wings 430, whereas the distance between the inside of the notches 330 and the inside of the tabs 320 is slightly more; thus, once the playing boards 400 are fitted into the interlocked support leg structure, they are, in addition to being held laterally secure by the tab and cavity mating, held vertically secure by the upward restraint of the nibs 310 in combination with the upward support of the support arms 300.

The entire apparatus is held vertically secure by the extensive reach of the bottom bases or feet 170 and 270 of the support legs 100 and 200, and by the counterweights 140 and 240 which work to offset the weight of the playing boards 400.

The entire apparatus is held rigid, in effect, by one column and its appendages, this column being positioned outside of all of the playing fields, and these appendages not utilizing any tight tolerances or cumbersome linkage techniques to secure the playing boards. The entire apparatus can be assembled in significantly less than a minute, and disassembled in approximately ten seconds. Thus, the apparatus is not only convenient to assemble and disassemble, it is ideal for use: that is, it is structurally sound and markedly accessible for the placement of playing tokens. It is conceived that the apparatus of the present invention may have useful applications outside of those used for game boards, to include book- and display-shelf apparatuses and sitting stools.

FIG. 1 shows an overall perspective view of the game board apparatus 10 of embodiment 1 at the beginning of the game of embodiment 1, wherein the game board is void of playing tokens 20, 21, 22, 25, 26, and 27, these playing tokens being located in two crypts or token holders or token-ordering mechanisms 30 of embodiment 1. The two crypts 30 correspond to the two opposing players, player 1's tokens 20, 21, and 22 being white, and player 2's tokens 25, 26, and 27 being black, thereby clearly distinguishing the two players' tokens from each other, each player's tokens being located in separate crypts 30.

Figure 5A:
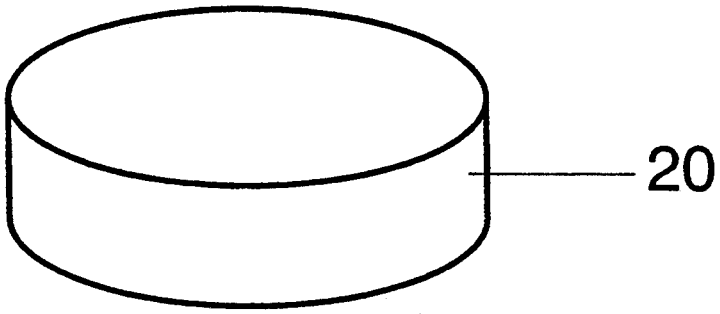
FIG. 5A is a perspective view of the integral token, or "whole" token, of embodiment 1.
Figure 5B:
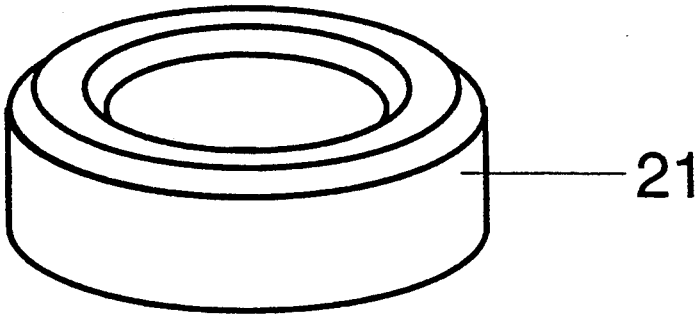
FIG. 5B is a perspective view of one of the distinct fractional tokens, or the "ring-half" token, of embodiment 1.
Figure 5C:
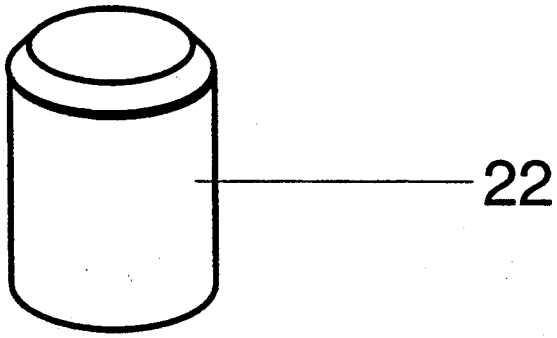
FIG. 5C is a perspective view of the other distinct fractional token, or the "peg-half" token, of embodiment 1.

FIGS. 5A–5C show close-up perspective views of the three distinct kinds of playing tokens 20/25, 21/26, and 22/27 of embodiment 1. Playing token 20/25 is an integral token or a token which, when placed on a playing zone 420, occupies that entire zone thereby rendering that zone unoccupiable by any other token. Playing token 21/26 is a fractional token or a token which, when placed on a playing zone 420, occupies only a distinct portion or fraction of that playing zone, smaller than the portion occupied by the integral token 20/25 which occupies the totality of all portions of the zone, and thereby leaves a different distinct portion of the playing zone empty or occupiable. Playing token 22/27 is also a fractional token, or a token which occupies the different distinct portion of a playing zone than does fractional token 21/26. In embodiment 1, token 20/25 is called a disc token, its disc shape representing the occupation of an entire playing zone; token 21/26 is called a ring token, its ring shape representing the occupation of a distinct half of a playing zone; token 22/27 is called a peg token, its peg shape representing the occupation of a distinct half of a playing zone wholly different than the distinct half occupied by token 21/26.

As the shapes of the tokens allow and make clear, either of tokens 21/26 may share any of the playing zones within playing field 410 with either of tokens 22/27. Neither half-token is more powerful than its complementary half-token; which is to say that, when a ring token 21, for example, is placed around a peg token 27, thus comprising a shared space 700 of FIG. 9H, the ring token does not in any way affect the peg token or alter the peg token's "peg-occupation" of the playing zone on which it had been placed before the placement of the ring token; all tokens remain where they have been placed and continue to occupy their particular portion of the zone where they have been placed. If a particular portion of a playing zone is empty, the type of playing token corresponding to that distinct portion, but to no more than that distinct portion, may be placed there, irrespective of which player that particular token belongs to. Thus, disc tokens 20/25 may be placed only on empty playing zones 420, ring tokens 21/26 may be placed only on empty or peg-occupied zones, and peg tokens 22/27 may be placed only on empty or ring-occupied zones.

Figure 6:
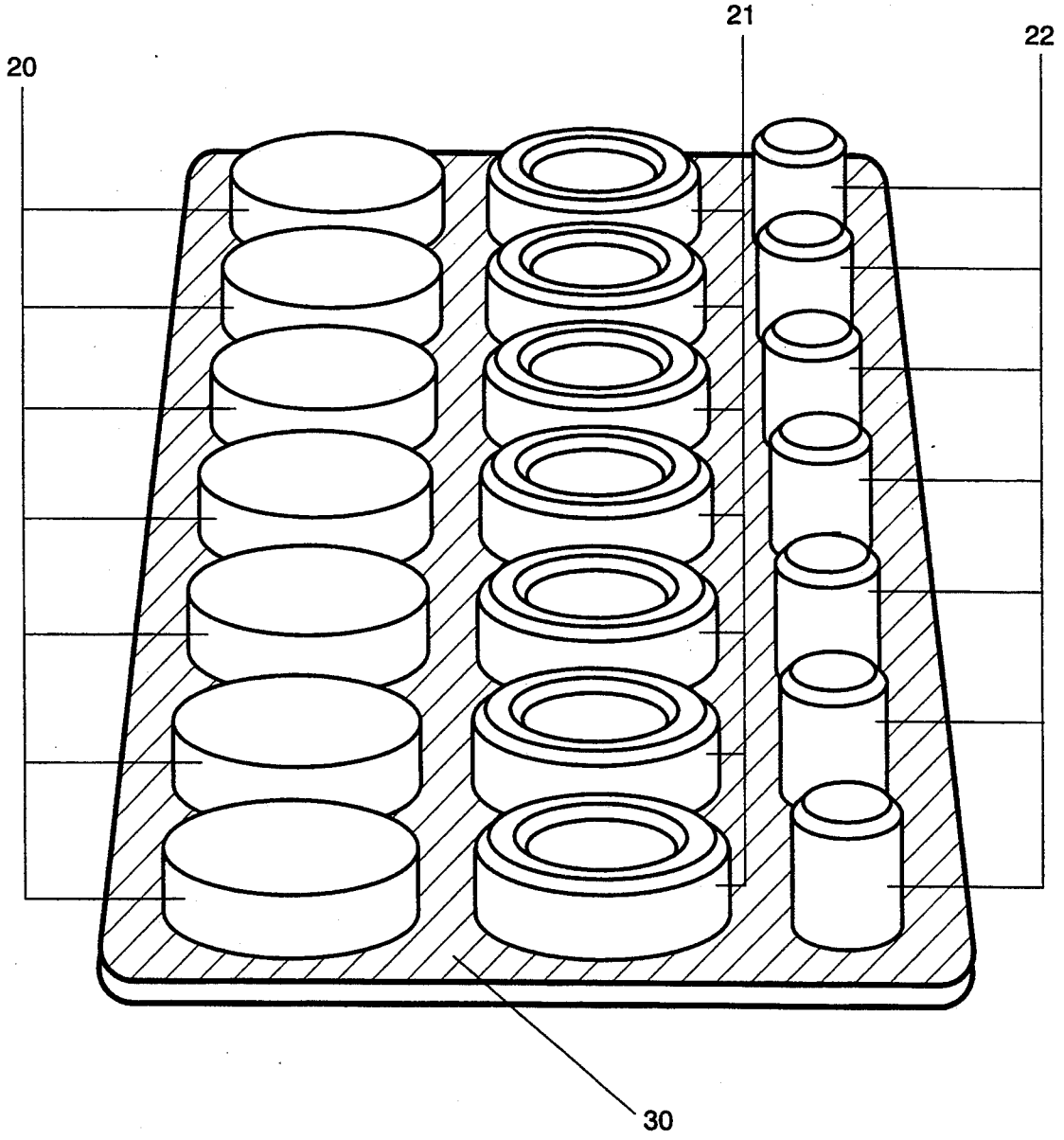
FIG. 6 is a perspective view of seven sequences of playing tokens of embodiment 1 held in the recesses of the token holder or token-ordering mechanism of embodiment 1.

The crypt or token-holder or token-ordering mechanism 30 of FIG. 6 keeps playing tokens ordered in a particular series for play known to all players. In embodiment 1, tokens are held by the crypt via recesses or depressions in the crypt corresponding to the shapes of the tokens of embodiment 1. In FIG. 6, player 1's disc tokens 20 are stored on one side of the crypt, his or her peg tokens 22 are stored on the opposite side, and his or her ring tokens 21 are stored between the two rows of disc and peg tokens. This storage of tokens in the crypt 30 determines a particular sequential, continuous, and predictable order in which the tokens are to be added, one-token-per-turn, to selected zones 420 of the game board 10. In a preferred embodiment, or embodiment 1, the order of play is as follows: first, the disc token is played, followed by the ring token, then by the peg token, and then the sequence of play resumes with the second disc token being played, the sequence continuing throughout the game.

Players also take turns, such that after player 1 places a disc token 20 on a selected zone, player 2 then places a disc token 25 on a playing zone capable of receiving this token or a zone unoccupied by player 1's disc token; next, player 1 places a ring token 21 on a zone capable of receiving it or a zone unoccupied by the two disc tokens, followed by the placement of a player 2 ring token 26 on a zone capable of receiving it or a zone unoccupied by the two disc tokens and player 1's ring token; next, player 1 places a peg token 22 on a zone capable of receiving it or a zone unoccupied by the two disc tokens, followed by player 2's placement of a peg token 27 on a zone capable of receiving it or a zone unoccupied by the two disc tokens and player 1's peg token.

Next, the sequence of disc-ring-peg begins again with player 1 placing his or her next disc token 20 on a zone capable of receiving it or a zone unoccupied by any of the previously placed tokens, followed by the placement of player 2's next disc token 25 on a zone capable of receiving it or a zone unoccupied by any of the placed tokens; next, player 1 places his or her next ring token on a zone capable of receiving it or a zone unoccupied by any disc token or any ring token, followed by the placement of player 2's next ring token 26 on a zone capable of receiving it or a zone unoccupied by any disc token or any ring token.

Each coupling of turns comprising the placement by both players of a particular type of playing token is called a round. Note that the placement of peg tokens is not restricted by previous placements of ring tokens, and that the placement of ring tokens is not restricted by previous placements of peg tokens.

Rounds continue in the prescribed sequence, made easily manageable by the crypt or token-ordering mechanism 30 of FIG. 6, until one player places, in a straight line of four contiguous zones 420 within any vertical, horizontal or diagonal plāne of the three dimensional playing matrix or board 10, tokens which occupy at least one identical portion of each zone within that line of four contiguous zones. While attempting to form such lines, players must simultaneously attempt, by the selective placement of tokens, to prevent an opponent from doing so. FIGS. 9A–9E, together, show five examples of winning alignments 500 of tokens in embodiment 1. Note that, since disc tokens comprise both portions of a playing zone or both distinct halves of the two fractional tokens, disc tokens may be employed in winning lines of either ring tokens or peg tokens. A disc token is, in effect, the union of a player's ring token and peg token. When a disc token is being employed in a line of one or more ring tokens, it does not cease to also be employable for a line of peg tokens also passing through the particular zone on which the given disc token is located. That is, disc tokens are always equal to the union of a player's ring token and peg token; there is, in effect, no difference between a zone occupied by one player's disc token and a zone occupied by that player's ring token and that player's peg token.

Figure 9A:
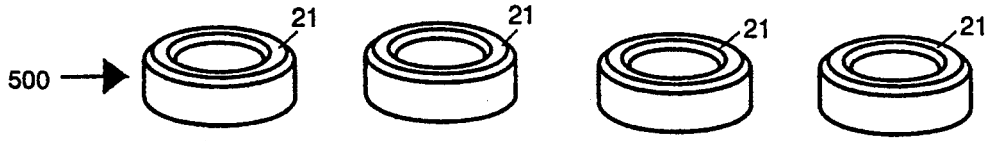
FIG. 9A is a perspective view of an example of a winning alignment of playing tokens of embodiment 1, four ting-half tokens, shown independent of the game-board apparatus.
Figure 9B:
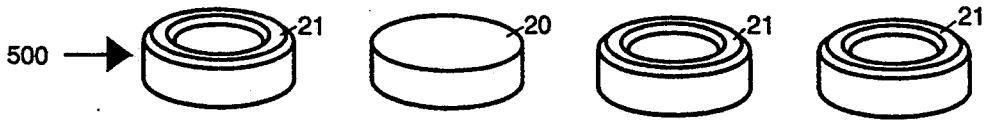
FIG. 9B is a perspective view of a second example of a winning alignment of playing tokens of embodiment 1, three ting-half tokens and a whole token, shown independent of the game-board apparatus.
Figure 9C:
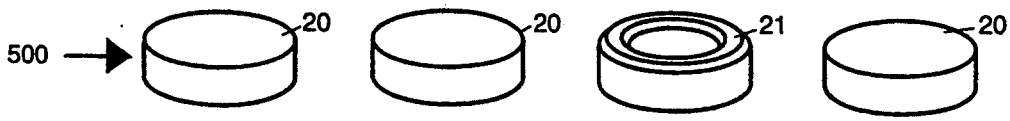
FIG. 9C is a perspective view of a third example of a winning alignment of playing tokens of embodiment 1, three whole tokens and a ring-half token, shown independent of the game-board apparatus.
Figure 9D:
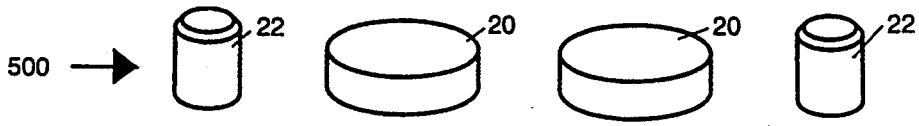
FIG. 9D is a perspective view of a fourth example of a winning alignment of playing tokens of embodiment 1, two peg-half tokens and two whole tokens, shown independent of the game-board apparatus.
Figure 9E:
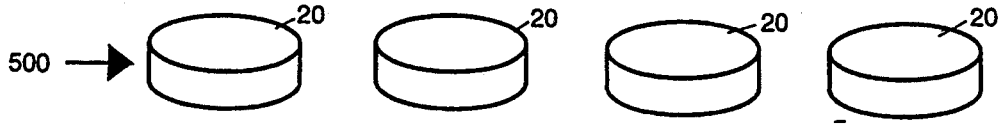
FIG. 9E is a perspective view of a fifth example of a winning alignment of playing tokens of embodiment 1, four whole tokens, shown independent of the game-board apparatus.
Figure 9F:
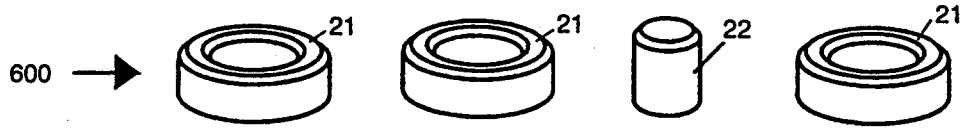
FIG. 9F is a perspective view of an example of a non-winning alignment of playing tokens of embodiment 1, three ring-half tokens and a peg-half token, shown independent of the game-board apparatus.
Figure 9G:
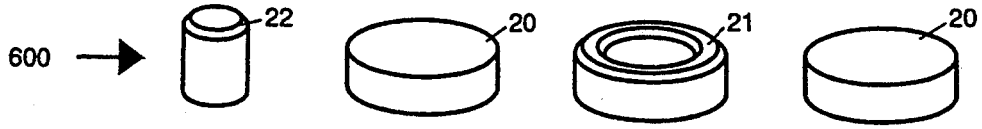
FIG. 9G is a perspective view of a second example of a non-winning alignment of playing tokens of embodiment 1, a peg-half token and a ting-half token and two whole tokens, shown independent of the game-board apparatus.
Figure 9H:
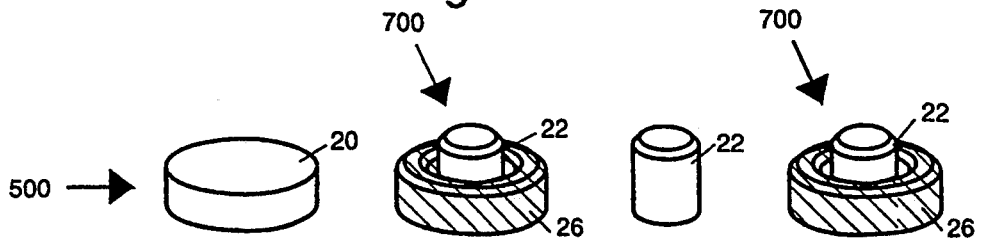
FIG. 9H is a perspective view of an example demonstrating how opposing players can occupy the same playing zone, here showing a winning alignment of one player's tokens of embodiment 1 penetrating two opponent's tokens, shown independent of the game-board apparatus.

FIG. 6 also shows two examples of non-winning lines 600 of four of a player's tokens. Because ring tokens and peg tokens do not occupy the same distinct portion of a playing zone, they cannot, by definition, in combination with each other form a winning alignment 500 wherein four contiguous zones in a straight line all contain tokens of one player occupying the same distinct portion of each playing field therein. A line of four tokens may even contain ring tokens, peg tokens, and disc tokens without constituting a winning alignment 500. A winning alignment of a particular player's peg tokens, or peg tokens and disc tokens, may lie within zones also containing that player's ring tokens, but it is irrelevant if this is the case. Similarly, a player's winning ring token alignment may contain that player's peg tokens, but it is irrelevant if this is the case. Significantly, this is also true of a winning peg alignment lying within zones which contain the opposing player's ring tokens; that is, in general, it is irrelevant what various other tokens, be they one's own or one's opponent's, lie on the zones comprising a winning alignment. FIG. 9H shows one example of a winning peg alignment penetrating an opponent's two ring tokens. Though the rings 27 and the pegs 22 share the same space 700, neither token captures or blocks the other.

In embodiment 1, the game is started with all playing tokens removed from the playing board 10. A decision is made as to which player will place the first token. This could be accomplished by numerous methods, including the rolling of a die, or a coin flip. The players then take turns selectively placing their various types of playing tokens onto the playing board 10, in the manner regulated by the token-ordering mechanism or crypt 30, until one player achieves a winning alignment. Tokens are not moved once placed.

To play the game, as described herein, requires skill and planning, but no greater basic understanding than that required for the conventional game of Tic Tac Toe. As opposed to alignment games in which tokens can be moved, and, in fact, must be moved before either player can manage to construct a winning alignment, the game of the present invention proceeds towards one focused end whereby the game never becomes ambling and frustratingly long, but rather builds in intensity as the game progresses.

To illustrate that the foregoing comprises a truly four dimensional strategy game, consider a hypothetical tic-tac-toe game played within a three dimensional playing matrix but with a plurality of identical playing tokens for each player, the tokens of one player being distinguishable from those belonging to the other player. Further consider that the placement of tokens on the playing matrix will occur during a plurality of turns, such that the first turn is "turn 1" and the second turn is "turn 2" and so on; also consider that each player will have a first turn and a second turn and so on, such that "round 1" can be defined as containing "turn 1" of player 1 and "turn 1, of player 2; rounds 2, 3, 4, and so on, being similarly defined.

Now consider, in this hypothetical tic-tac-toe game, that each playing zone within the matrix has three distinct time or turn "ports", such that, if a player places a token through a certain one of these ports, which shall be called a "constant port", the playing token will exist on that zone at all points of time or on all rounds and turns, thereby occupying the totality of the zone as in conventional Tic-Tac-Toe. Further consider that if a player places a token through a particular other of the three ports, which shall be called an "even port", the token will exist on that zone in the playing board only at particular times during the game, those times comprising the even-numbered rounds of turn-taking. Further consider that if a token is placed through the last of the three ports, which shall be called an "odd port", the token will exist on that zone only during odd-numbered rounds. Thus, in this hypothetical tic-tac-toe game, the existence of a particular token on the playing matrix at any given time will depend entirely on the particular time port through which it was placed.

Lastly consider, in this hypothetical game, that, for any particular round during the game, only one of the three time ports will be open for the passage of playing tokens, this same type of port being open on all zones of the playing matrix. As an embodiment of such a game, imagine that constant ports will open for the first round of play, the fourth round, the seventh round, and so on for every third round thereafter, and, further, that the odd ports will open for all odd rounds excluding those odd rounds named for the constant ports, and that the even ports will open for all even rounds excluding those even rounds named for the constant ports. However, further consider, as specified in the preceding paragraph, that the tokens placed through odd ports on playing zones during "odd port rounds" will exist on the playing matrix during all odd rounds, even those reserved for the opening of the constant ports, and that the tokens placed through even ports on playing zones during "even port rounds" will exist on the playing matrix during all even rounds, even those reserved for the opening of the constant ports.

Thus, in such a game, on certain turns, certain previously placed tokens do not exist, thereby abandoning their occupation of their zones only to reappear on later turns. Zones having only partial temporal occupation cannot, however, be invaded by tokens placed during constant rounds, since their partially occupied temporal regions will necessarily "block out" any token seeking to occupy the totality of their temporal space. Tokens placed during constant rounds, thereby constantly existing on the matrix, will work in conjunction with either of the two intermittently existing tokens to form winning alignments.

Talking of the occupation of "temporal regions" as with the above hypothetical game is a confusing enterprise. However, a close analysis of the proposed hypothetical game will reveal that its defining four-dimensional attributes are essentially identical to those elements detailed for the present invention: the "constant ports" being analogous to integral tokens, the "even ports" and "odd ports" being analogous to two distinct fractional tokens, and the patterned and predictable opening of the various ports being analogous to the token-ordering mechanism. Thus, the present invention, while translating the more elusive temporal dimension into an aggregate dimension of easily tangible spatial attributes, remains, nonetheless, distinctly four dimensional both in conception and in play.

As such, the foregoing is considered as illustrative only of the basic "four dimensional" principle of the invention. Numerous elements of the above embodiment (embodiment 1) may be varied and expanded upon within the scope of the invention. FIGS. 8D–8I, for example, together show an embodiment 80 wherein the integral token is partitioned into further fractional divisions than those comprised by the half-tokens of embodiment 1. The integral is divided into distinct thirds, and these thirds are paired into various distinct two-thirds groupings. Thus, the token-ordering mechanism for this proposed embodiment might order playing tokens such that the integral token would be played in the first round, the two-thirds-AB token in the second round, the two-thirds-BC token in the third round, the third-A token in the fourth round, the third-B token in the fifth round, and the third-C token in the sixth round, with the sequence beginning again in the seventh round with the next integral token.

In this "distinct thirds" embodiment 80, the objective of the game would still be to achieve an alignment of any one type of third-token, with the two distinct two-thirds tokens and the integral token functioning in the game as tokens linking or acting in various distinct third-token alignments. Note in this embodiment that the option of having a two-thirds-AC token is not included; this omission would serve to create a particular dynamic to play as distinct from a game including all combinations of thirds; it is therefore desirable to manipulate the composition of the tokens and the order in which they are played for any particular embodiment of the invention, while still maintaining the four-dimensional character, as this will allow for interesting variation.

Since numerous modifications and changes will readily occur to those skilled in the art, it is not desired to limit the invention to the exact construction and operation shown and described. Accordingly, all suitable modifications and equivalents may be resorted to, following within the scope of the invention as described in the following claims.

I claim:

1. A three dimensional board game apparatus comprising:

(a) a plurality of rigid and transparent playing boards of substantially thin depth or thickness, said playing boards being stacked one above the other in different horizontal planar levels, the distance between each pair of said planar levels being sufficient to allow manual access for placing playing tokens on said playing boards, each of said playing boards comprising:

(b) a playing field, having at least two substantially orthogonal adjacent sides, said playing field comprising a plurality of playing zones;

(c) two wings or supporting projections within the same plane of said playing field; one of said wings projecting perpendicularly from one of said orthogonal adjacent sides of said playing field, the other of said wings projecting perpendicularly from the other of said orthogonal adjacent sides; said wings being absent from said adjacent sides for a distance beginning at the nose or corner of intersection of said adjacent sides, and extending along said adjacent sides for a length substantially short in comparison to that of said adjacent sides; after which said length, each of said wings there beginning with an innermost edge, each said innermost edge being perpendicular to its contiguous side of said playing field; each of said wings containing one cavity being cut perpendicular to the plane of said playing board and positioned substantially to the opposite or distal end of said wing with respect to said wing's innermost edge;

(d) said apparatus further comprising a stand for supporting said playing boards in said stacked configuration of (a), said stand comprising two supporting partner legs, each of said legs consisting of components lying substantially within a single geometric plane and comprising:

(e) a vertical support post or plank of sufficient height to span at least the entire height of said stacked configuration of said playing boards of (a); said post having width within said geometric plane of (d) slightly less than the distance between said nose of said playing field of (c) and said innermost edge of said wing of (c); said post having thickness or depth perpendicular to said geometric plane measuring slightly less than the outward projecting length of said innermost edge of said wing of (c), thereby defining said length of said innermost edge;

(f) each of said legs further comprising a plurality of horizontal support arms, equal in number to that of said playing boards, projecting perpendicularly and in a single direction from said post, defining more clearly said single geometric plane of said leg; the vertical distance between each pair of said support arms corresponding to, and being substantially equal to, said sufficient distance necessary for manual access between each pair of said playing boards of (a);

(g) each of said legs further comprising a plurality of restraining nibs, equal in number to that of said support arms, projecting from said support post in substantially the same direction as that of said arms; each of said nibs positioned directly above each of said arms, the vertical distance between each of said arms and its corresponding said nib being slightly greater than said depth or thickness of said playing boards;

(h) each of said legs further comprising a plurality of restraining tabs, equal in number to that of said support arms, one of each of said tabs projecting vertically from one of each said arms, and positioned on each of said arms at a distance from said support post slightly greater than the distance between said innermost edge and said cavity of (c); the horizontal distance between said tab of each of said arms and the outermost edge of the projection of said nib above each of said arms being slightly but significantly less than the distance between said innermost edge of (c) and said cavity of (c), thereby defining the projecting length of said nibs; said tabs being constructed to fit securely with suitable tolerance gap inside said cavities of (c);

(i) each of said legs further comprising a plurality of juts, with contiguous interstices or gaps, projecting perpendicularly from the side of said support post opposite that of said support arms, still falling within said single geometric plane of (d); each said jut on said leg having a corresponding or mating gap on said partner support leg of (d); said juts having projecting length slightly greater than said thickness of said support post of (e); said gaps having projecting length from said post equal to said projecting length of said juts, and having a height along the vertical line of said support post at least slightly greater than the corresponding height of said corresponding jut on said partner leg; said partner legs thereby being capable of fitting together or mating, via said juts on one said leg fitting into said gaps on said partner leg, in interlocking or hinge-like fashion; said single geometric planes of each of said partner legs intersecting one another, when said partner legs are interlocked in said fashion, at a substantially right angle, corresponding to the right angle formed by said adjacent orthogonal sides of playing field in (b);

(j) each of said legs further comprising a plurality of rear restraining hooks projecting, from a selection of said juts of (i), both horizontally outward, in the same said direction of projection of said juts, and also immediately in a vertical direction, perpendicular to said direction of projection of said juts, still within said single geometric plane of (d); the near edge of said rear restraining hook being defined by the beginning of said horizontal projection from said jut; said near edge, in its vertical projection, butting directly against the far horizontal projecting reach of said interstices or gaps of (i), thereby tangibly defining the projecting length of said gaps, either for part of, or for the entire, said height of said gaps of (i);

(k) each of said legs further comprising one or more planar counterweights, each said counterweight projecting outwardly within said single geometric plane of said leg and in the same said direction of projection as said juts; each said counterweight beginning its said outward projection from a selected said jut; said counterweight being of construction enabling it to fit through its appropriate corresponding said gap or interstice of (i) on said partner leg;

(l) each of said legs further comprising a foot or bottom base, being either an extension of bottom said support arm of said leg or independent of said bottom arm; said foot projecting outwardly from said support post in the same said direction of projection as said support arms and being of a suitable shape on its bottom surface to allow for placement of entire said interlocked structure of said partner legs of (i) on flat horizontal surface;

(m) said apparatus being assembled by interlocking said partner legs in said hinge-like fashion of (i), thereby forming said stand of (d) to be placed on said flat horizontal surface of (l); then inserting said playing boards of (a) onto said support arms of (f), wherein:

(n) said nose of (c) butts substantially into the corner of intersection of said partner legs of (i);

(o) said innermost edges of (c) fit securely under said nibs of (g), thereby restricting upward movement of said nose;

(p) said cavities of (c) fit securely around said tabs of (h), thereby restricting lateral movement of said playing boards;

(q) whereby, without use of clamps, screws, snaps, springs, glue or any other such added device or mechanism traditionally employed for securing similar three-dimensional apparatuses, including the use of exceptionally tight tolerances, the claimed apparatus is made:

(r) sturdy and shock-resistant;

(s) both vertically and laterally stable;

(t) substantially free from optical confusion to user, due to absence of protruding, shadow-casting, and light-refracting supporting columns within said playing fields;

(u) moveable by grabbing any one point of either of said support legs;

(v) tiltable in all directions, in manner of (u), up to an angle of 90 degrees from upright with as few as one of said playing boards inserted into said interlocked support legs;

(w) markedly facile, quick, and uncomplicated to assemble and disassemble;

(x) easily packageable and manufacturable due to the relative flatness of all component parts; and (y) markedly accessible for said placing of playing tokens on said playing boards.

2. A three dimensional board game apparatus comprising:

(a) a plurality of playing boards stacked one above the other in different horizontal planar levels, each of said playing boards comprising:

(b) a playing field comprising a plurality of playing zones;

(c) a rigid planar matrix or means within said playing board for rendering said playing board substantially unbendable and uncollapsible;

(d) three linkage mates or means for coupling said playing board with a support stand having three complementary mates, all said linkage mates of said playing board being located on said rigid planar matrix of (c); said linkage mates of said playing board comprising:

(e) a corner mate positioned substantially near a corner of said playing board;

(f) two distal mates positioned substantially far from said corner and substantially far from each other, said distal mates comprising:

(g) an east distal mate positioned to the right of said corner mate when viewed from a vantage point behind said corner wherein the plane of said playing board appears substantially as a line and wherein said corner lies between said distal mates;

(h) a west distal mate positioned to the left of said corner mate when viewed from said vantage point of (g);

(i) said linkage mates of (d) thereby comprising an angle described by two imaginary straight lines, one said line running from said east distal mate to said corner mate, the other said line running from said west distal mate to said corner mate;

(j) said apparatus further comprising said support stand of (d) or means for supporting said playing boards in said stacked configuration of (a), said stand comprising:

(k) a vertical support post of sufficient height to span at least the entire height of said stacked configuration of said playing boards of (a);

(l) a plurality of horizontal support arms projecting perpendicularly from said vertical support post; said arms being grouped into brother pairs wherein the two arms of each said brother pair are located at identical heights along said support post of (k) and begin their said projections substantially from a common origin point on said post; said pairs being equal in number to that of said playing boards; each said pair comprising an east arm and a west arm;

(m) said stand further comprising a plurality of vertical restrictor mates or means for restricting the vertical movement of said corner of (d) by means of mating with said corner mate of (e); the number of said vertical mates being equal to that of said playing boards; said vertical mates being located, one per said pair of brother arms, substantially at said common origin point of said brother arms, on said vertical support post;

(n) said stand further comprising a plurality of lateral restrictor mates or means for restricting the lateral movement of said playing boards by means of mating with said distal mates of (f); the number of said lateral mates being equal to that of said distal mates; said lateral mates being divided into east lateral mates and west lateral mates, the group of said east lateral mates being equal in number to the group of said west lateral mates; said east lateral mates being located, one per said east arm of (l), atop said east arm at a distance from said common origin point of (m) equal to the distance separating said east distal mate of (g) and said corner mate of (e); said west lateral mates being located, one per said west arm of (l), atop said west arm at a distance from said common origin point of (m) equal to the distance separating said west distal mate of (h) and said corner mate of (e); wherein a support angle is described by two imaginary straight lines, one said line running from the east lateral mate on said brother pair of (l) to the vertical mate of said brother pair, the other said line running from the west lateral mate on said brother pair to the vertical mate of said brother pair; said support angle corresponding to and being substantially equal to said angle of (i), whereby all said mates on said support stand of (j) are positioned to neatly and mutually couple with their corresponding said linkage mates of (d) located on said playing boards of (a);

(o) said stand further comprising a means for securing vertical projection of said support post of (k), whereby all of said support arms maintain a substantially horizontal projection; said means for securing vertical projection of support post to include but not to be limited by:

(p) the bottom of said post being inserted into a receiving hole of a substantially stable base;

(q) the bottom of said post being secured by suitable means to a substantially stable multi-legged, tripod-like stand;

(r) said apparatus being assembled by securing vertical projection of support posts in manner of (o), thereby forming said stand of (j), then inserting said playing boards of (a) onto said support arms of (l), wherein:

(s) said distal mates of (f) mate securely with said lateral restrictor mates of (n), thereby restricting lateral movement of said playing boards;

(t) said corner mates of (e) mate securely with said vertical restrictor mates of (m), thereby restricting, in combination with said rigid planar matrix of (c) resting on said support arms of (l), vertical movement of said playing boards;

(u) whereby the claimed apparatus is made able to support with stability relatively large playing boards from only one support post falling outside of said apparatus's playing fields, said apparatus thereby being both structurally trustworthy and markedly accessible for the placing of playing tokens on said playing boards.

3. The apparatus of claim 2 wherein said support stand of (j) is comprised of two supporting partner legs; one said partner leg being considered the east partner leg and comprising all said east support arms of (l), the other said partner leg being considered the west partner leg and comprising all said west support arms of (l); each said partner leg further comprising a vertical support wherefrom said support arms project in the manner of (l); said partner legs further comprising a means for interlocking said legs substantially near said vertical supports, whereby said vertical supports, when coupled by said interlocking, substantially resemble or function as one unified support post or said support post of (k).

4. The apparatus of claim 3 wherein said interlocking of said partner legs is accomplished by means of each said vertical support having, along a vertical strip separate from those areas from which said support arms project, a series of juts and gaps, wherein said juts on said east leg correspond and mate with said gaps on said west leg, and said gaps on said east leg correspond and mate with said juts on said west leg.

5. The apparatus of claim 4 wherein said interlocking of said partner legs is held secure by means of a plurality of pairs of rear interlocking hooks, each said hook projecting from a selected said jut on said partner leg; wherein an upwardly projecting hook on one said leg corresponds to and mates with a downwardly projecting hook located at an equal height on said partner leg.

6. The apparatus of claim 5 wherein at least one pair of said interlocking hooks is joined to a counterweight device, and wherein a foot or bottom base projects horizontally from the bottom or base of each of said vertical supports, said foot being of a suitable shape on its bottom surface to allow for placement of entire said interlocked structure of said partner support legs on flat horizontal surface; said counterweight being connected to the side of said interlocked vertical supports opposite that of said playing boards of (a), thereby balancing the weight of said playing boards and providing for said means of securing vertical projection of (o).

7. The apparatus of claim 6 wherein said counterweight is a contiguous and joined extension of a selection of juts on each of said legs, said joined counterweight being of a size and shape still suitable for said interlocking of said partner legs by means of said juts and said gaps; and wherein each of said partner support legs is substantially planar: said support arms, said support posts, said juts, and said counterweights of each said support leg falling substantially within a single geometric plain; whereby the angle of intersection of said planar support legs is substantially equal to said support angle of (n).

8. The apparatus of claim 2 wherein said corner mate of (e) is a small horizontal fin near said corner of said playing board, said fin being constructed to fit neatly into a notch or said vertical restrictor mate of said support post directly above said brother pair of support arms; and wherein said distal mates of (f) are cavities constructed to fit neatly around tabs or said lateral restrictor mates on said brother pairs of support arms.

9. A method of playing a game comprising:

(a) providing at least two groups of playing tokens, one group for each player, each group of playing tokens comprising:

(b) a set or plurality of identical integral or undivided playing tokens;

(c) a plurality of mutually distinguishable sets of distinct fractional playing tokens; each said set of said fractional tokens comprising a plurality of identical said fractional tokens; each of said fractional tokens within each said set of fractional tokens comprising a distinct portion or fraction of each of said integral tokens, (d) providing a playing field having a plurality of playing zones of equal receptivity to all said playing tokens of (a);

(e) defining a round as comprising the placement of a single distinct type of playing token of (b) and (c), one and the same said distinct type of playing token for each said player, onto said playing field; all said players having placed said distinct type of playing token, a new round then beginning;

(f) providing a token-ordering mechanism or means for regulating, in a manner known and predictable to all said players, which said distinct type of playing token of (e) is to be placed onto said playing field by all said players on any particular round during said game, whereby said distinct type of playing token to be added to the playing field by any said player is governed entirely by said token-ordering mechanism;

(g) defining each said playing zone of (d) as being able to receive no two identical types of playing tokens, and, further, as being able to receive no two types of playing tokens comprising any same distinct portion of said integral token; whereby said playing zone is entirely occupied when one of said integral tokens is placed thereon, and also when a combination of mutually distinct types of said fractional tokens comprising, in total, all distinct portions of said integral token is, through a series of said rounds, placed thereon, wherein said combination of tokens may belong to any collection of said players, including any single said player;

(h) stipulating, when a playing zone contains one or more playing tokens comprising particular portions of said integral token, that said playing zone is considered to have said particular portions occupied; whereby said playing zones are considered to have distinct portions, corresponding to said portions of (c), to be occupied by playing tokens of (b) and (c);

(i) selecting the order in which said players will commence play and take turns placing said playing tokens on said playing field;

(j) each said player taking turns in the manner of (i) selectively placing said playing tokens, in a manner determined by token-ordering mechanism of (f), on said playing zones able to receive said playing tokens in the manner of (g); wherein the objective of said game for each said player is to occupy, with said player's own playing tokens, the same distinct portion of each playing zone in one continuous line of said playing zones, said line being of predetermined length, while, by strategically placing tokens in the manner of (h), preventing said player's opponents from doing so; wherein for a winning alignment, it is irrelevant what other portions of said zones of said alignment may be occupied by other playing tokens of other opponents, provided that said playing zones comprising said winning alignment all contain playing tokens of said one player, occupying, in the manner of (h), the same distinct portion of each playing zone therein.

10. The method of claim 9 wherein said playing field of (d) is initially void of playing tokens.

11. The method of claim 9 wherein said playing field of (d) is a three-dimensional matrix of playing zones, wherein said continuous line of (j) may be formed within any vertical, horizontal, or diagonal plane of said matrix.

12. The method of claim 9 wherein said fractional playing tokens of (c) comprise two distinct halves of said integral token of (b).

13. The method of claim 12 wherein said distinct halves are represented by: a ring-shaped playing token, and a peg-shaped playing token constructed to fit neatly inside of said ring-shaped token; the union of said ring-shaped token and said peg-shaped token comprising the third or said integral token represented by a disc-shaped token constructed to resemble said union of said ring-shaped token and said peg-shaped token.

14. The method of claim 9 wherein said integral playing token of (b) is considered to be divided into three distinct portions, said fractional playing tokens of (c)

being comprised out of the possible combinations of said three distinct portions, to include: three distinct thirds tokens and three distinct two-thirds tokens, each said two-thirds token being differently comprised of the three possible combinations of said distinct thirds.

15. The method of claim 9 wherein said integral playing token of (b) is considered to be divided into four distinct portions, said fractional playing tokens of (c) being comprised out of the possible combinations of said four distinct portions, to include: four distinct fourths tokens, six distinct halves tokens, and four distinct three-fourths tokens; each said halves token being differently comprised of the six possible combinations of said distinct fourths, and each said three-fourths token being differently comprised of the four possible combinations of said distinct fourths.

16. The method of claim 9 wherein said token-ordering mechanism of (f) arranges said playing tokens such that one of each of said types of playing tokens of (b) and (c) is played before any of said types of tokens is played again.

17. The method of claim 16 wherein the order of playing tokens comprised by the first exhaustive series of mutually distinct types of tokens played is repeated throughout said game, whereby said distinct tokens are played in a continuous, sequential, and unchanging order throughout said game.

18. The method of claim 9 wherein there are two players; and wherein said playing field of (d) is a three-dimensional symmetrical matrix, having four playing levels arranged one above the other, each said level having four rows and four columns of said playing zones of (g) and (h); and wherein said matrix is initially void of playing tokens; and wherein said fractional tokens of (c) comprise two distinct halves or portions of said integral token of (b); and wherein said two distinct half-tokens are constructed to fit neatly together, thereby resembling the construction of said integral token which comprises the union of said distinct half-tokens; and wherein said token-ordering mechanism of (f) comprises two playing-token holders, one for each player, wherein the quantity of tokens not yet played and the order in which said unplayed tokens are to be played is clearly visible to both said players; and wherein all three said types of playing tokens are played in the first three rounds of turns of (e), comprising a continuous, sequential, and unchanging series to be precisely repeated throughout said game, said series comprising: first, said integral token, second, one of said distinct half-tokens, and third, the other of said distinct half-tokens; and wherein tokens are not moved once placed on a selected playing zone; and wherein both said players, with said distinct types of half-tokens, according to (h), may occupy different portions of the same said playing zones; and wherein the objective for each said player in said game is to be the first to assemble an alignment of four of the same said distinct type of half-token within four consecutive collinear playing zones in any vertical, horizontal, or diagonal plane of said three dimensional matrix or playing field, wherein said integral tokens, which comprise both said half-tokens, are employed in any of said alignments and in any number to include the totality of said alignment; a concurrent objective of said game being to prevent the opposing player front assembling said alignment;

whereby the claimed method of playing a game comprises a truly four-dimensional strategy game, wherein three dimensions are comprised by the three-dimensional playing field, and the fourth dimension, analogous to time, is comprised by the continuous, sequential, and predictable manner wherein distinct types of playing tokens, having a compositional relation to one another, are added to the playing field and may therein share occupation of playing zones used for constructing winning alignments; said representation of a fourth dimension being most clearly analogous to a system in which certain types of playing tokens could only be played and would only exist at certain times or during certain turns, while other playing tokens, here analogous to said integral tokens, though being played only on certain turns, would exist on the playing field at all times or on all turns and would thereby function as any and all other intermittently existing tokens, here analogous to said fractional tokens.

* * * * *